United States Patent [19]

Battle

[11] Patent Number: 5,033,584

[45] Date of Patent: Jul. 23, 1991

[54] ALL-PURPOSE LADDER

[76] Inventor: Harold P. Battle, 25 Winyah Ter., New Rochelle, N.Y. 10802

[21] Appl. No.: 487,536

[22] Filed: Mar. 2, 1990

[51] Int. Cl.[5] ..... E06C 1/30; E06C 7/04

[52] U.S. Cl. ..... 182/168; 182/208

[58] Field of Search ..... 182/168, 208, 108

[56] References Cited

U.S. PATENT DOCUMENTS

| | | | |
|---|---|---|---|
| 375,250 | 12/1887 | Bailey | 182/168 |
| 886,737 | 5/1908 | Taylor | 182/168 |
| 1,077,650 | 11/1913 | Stroud | 182/168 |
| 1,423,104 | 7/1922 | Glasser | 182/208 |
| 1,986,477 | 1/1935 | Kenyon | 182/168 |
| 2,650,750 | 9/1953 | Chesney | 182/108 |
| 2,880,920 | 4/1959 | Glessner | 182/208 |
| 2,992,696 | 7/1961 | Jedinak | 182/108 |

FOREIGN PATENT DOCUMENTS

| | | | |
|---|---|---|---|
| 585918 | 11/1958 | Italy | 182/208 |

*Primary Examiner*—Reinaldo P. Machado
*Attorney, Agent, or Firm*—Darby & Darby

[57] ABSTRACT

An all purpose ladder includes a fixed base ladder segment that is conventionally made with long side pieces that are connected together by rungs or steps. An upper ladder segment comprises a pair of long side pieces connected together by rungs. As is conventional with extendible ladders, the side pieces of the upper ladder segment are in sliding engagement with the side pieces of the base ladder segment. A screw or worm shaft is rotatably mounted to one side piece of the lower ladder segment and a threaded bracket engages both the upper ladder segment and the screw or worm shaft such that when the screw or worm shaft is rotated about its longitudinal axis, the bracket travels along the length of the screw or worm shaft, thereby moving the upper segment relative to the fixed base ladder segment. Gears and a handle are provided so that a user can adjust the relative extension position between the base ladder segment and the upper ladder segment on a continuous basis. Struts or legs pivotably extend from an upper part of the base ladder segment to the ground to provide a triangular support structure such that the ladder may be freestanding. When standing vertically, the sliding ladder segment can be raised until it contacts a ceiling. Also, objects can be held against the ceiling by pressing them upwardly with the ladder. Loads can be elevated by being placed on or attached to the sliding upper ladder segment before it is raised. A pair of all-purpose ladders may be used like a scaffold by putting a platform between them.

8 Claims, 2 Drawing Sheets

ALL-PURPOSE LADDER

FIELD OF THE INVENTION

This invention relates generally to ladders and, more particularly, to a ladder that is adjustable for use where both high and low ladders were previously required.

BACKGROUND OF THE INVENTION

Ladders come in a variety of sizes. Short ladders, known as step ladders, have legs which make the ladder freestanding. Step ladders are generally not adjustable in height and come with a fixed number of steps. Longer ladders usually lean against a wall or outer building surface for support. Where a tall ladder is required, an extension type ladder is used that is made up of several segments, at least one of which is slidable relative to a base or lower ladder segment. By pulling on a cord or a cable, the extendable segment is moved relative to the lower segment, thereby extending the overall length of the ladder. A hooking arrangement is provided between the two segments to lock them together when a desired extension is achieved. This arrangement includes a hook like device on the moving portion, which engages the fixed base segment, for example, a rung or step to prevent the elevated segment from sliding back down. Thus, the extension ladder can be lengthened in incremental steps that correspond to the distance between adjacent ladder rungs.

Step ladders are easily operated and relatively safe for the average user, for example, the do-it-yourself person, working around the interior of the house. The major disadvantage of the step ladder is its fixed height and its major advantage is its small size, for use with low heights, and its supporting struts or legs which make the step ladder freestanding.

A disadvantage of the extension type ladder is the awkwardness in setting it up against a supporting wall, building side, tree limb, etc., and in operating the rope and latching devices for extending the ladder. Another disadvantage of the extension ladder is that it extends only in increments corresponding to the spacing between the ladder rungs. A further disadvantage is that the extension ladder is not freestanding. Therefore, when working at the center of a room, away from the walls, the extension ladder is not useful, and a worker must use scaffolding and the like when a step ladder is not of sufficient height.

What is needed is an all purpose ladder that can serve the functions of both a step ladder and also an extension ladder.

SUMMARY OF THE INVENTION

It is an object of this invention to provide an improved all-purpose ladder that serves the functions of a step ladder and also of an extension ladder.

Another object of this invention is to provide an improved all-purpose ladder that is extendible in height by continuous adjustment rather than incremental steps.

A further object of this invention is to provide an improved all-purpose ladder that can be used in three modes, namely, freestanding, leaning against a wall or similar object, or wedged between the floor and ceiling of a room.

Yet another object of this invention is to provide an all purpose ladder that can be used in lifting loads.

A further object of this invention is to provide multiple all-purpose ladders that can be used to create an adjustable height scaffold.

In accordance with a preferred embodiment of the invention, the all purpose ladder includes a fixed base or lower ladder segment that is conventionally made of a pair of parallel long side pieces that are connected together by cross pieces, rungs or steps, that are at right angles to the side pieces. The steps are generally equally spaced apart.

An upper ladder segment comprises a pair of parallel long side pieces connected together by respectively parallel cross pieces that form steps. The side pieces of the upper ladder segment are in sliding engagement with the side pieces of the base or fixed ladder segment, as is conventional.

A screw or worm shaft is rotatably mounted to one side piece of the lower ladder segment and a threaded bracket engages both the upper ladder segment and the screw or worm shaft such that when the screw or worm shaft is rotated about its longitudinal axis, the bracket travels along the length of the screw or worm shaft, thereby moving the upper segment.

The bracket is fixedly connected to the upper or sliding ladder segment near the lower end thereof. Accordingly, when the screw or worm shaft is rotated, the bracket travels the length of the screw or worm shaft causing the upper ladder segment to translate relative to the fixed base ladder segment so that the overall permissible extension length of the ladder is achieved. Gears and a handle are provided so that a user can adjust the relative extension position between the base ladder segment and the upper ladder segment on a continuous basis.

Struts or legs pivotably extend from an upper part of the base ladder segment to the floor or ground to provide a triangular support structure, similar to a step ladder, such that the ladder may be freestanding. Since these struts or legs are pivoted, they may be withdrawn to rest against the base ladder segment when the ladder leans against a wall or it is stored. As an alternative, the struts or legs may extend from an upper end of the upper ladder segment to the ground level, to make the ladder freestanding.

When standing vertically, the sliding ladder segment can be raised until it contacts a ceiling. For this purpose, protective padding is provided at the upper end of the ladder so as not to damage the ceiling. Also, objects can be held against the ceiling by pressing them upwardly with the ladder. Thus, an object to be fastened to a ceiling may be held in place by the ladder, leaving the worker with both hands free to make the attachment. Loads can be elevated by being placed on or attached to the sliding upper ladder segment before it is raised. A hook may be provided near the lower end of the sliding ladder segment and used to raise loads, for example, like a jack under the bumper of an automobile.

A pair of all-purpose ladders may be used like a scaffold by putting a platform between them. The platform, including a load, may be elevated by turning the worm or screw shaft on both ladders substantially simultaneously so the platform is kept in a horizontal or near horizontal condition at all times while it is being elevated.

Other objects and advantages of the invention will be apparent from the following detailed description. The invention accordingly comprises the features of construction, combination of elements and arrangement of parts which will be exemplified in the constructions hereinafter set forth, and the scope of the invention will be indicated only by the appended claims.

BRIEF DESCRIPTION OF THE DRAWINGS

For a fuller understanding of the invention, reference is made to the following detailed description taken in connection with the accompanying drawings, in which.

DETAILED DESCRIPTION OF THE PREFERRED EMBODIMENTS

Figure 1:
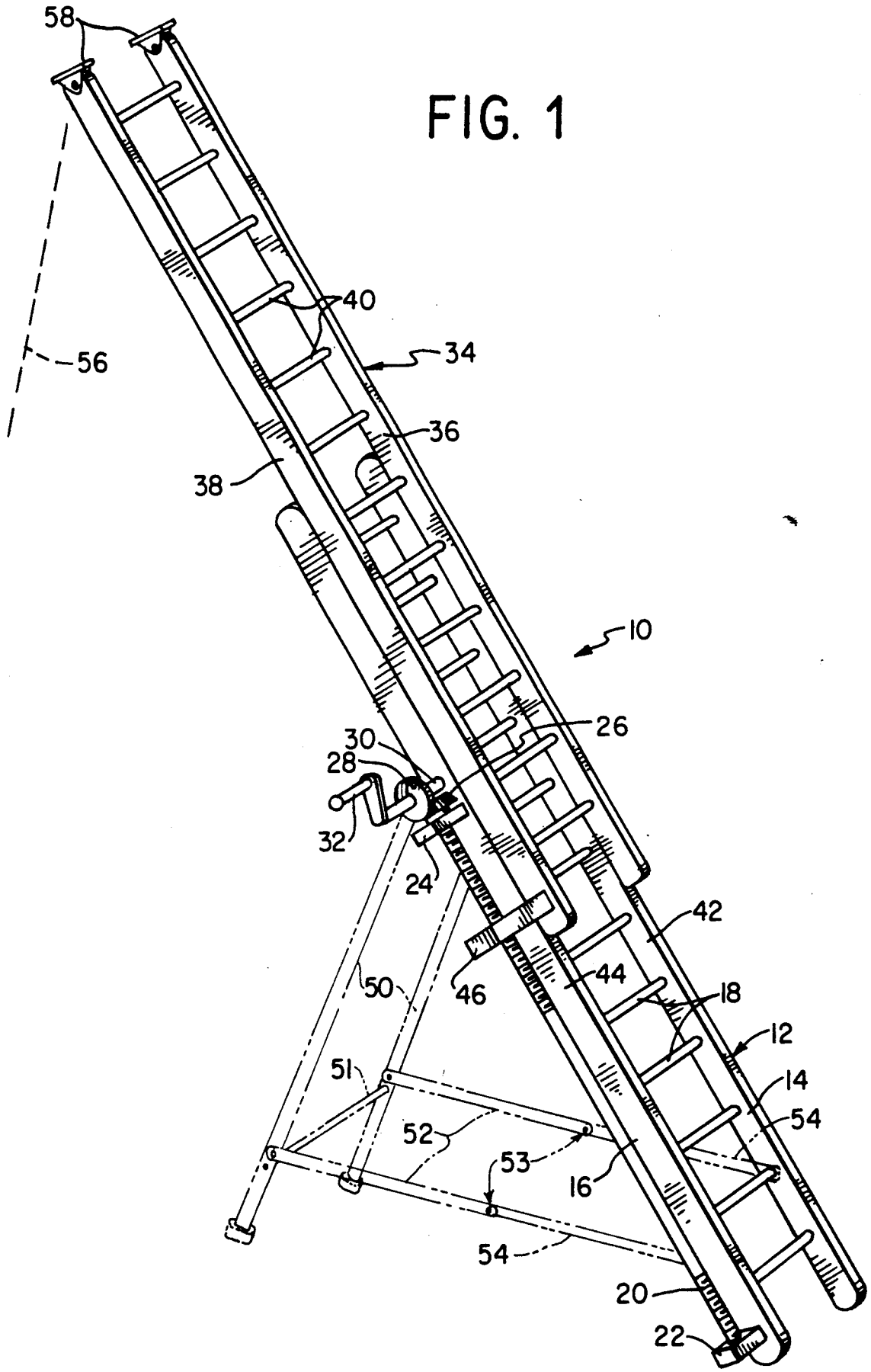
FIG. 1 is a perspective view of an all purpose ladder in accordance with the invention, shown in an extended state.
Figure 2:
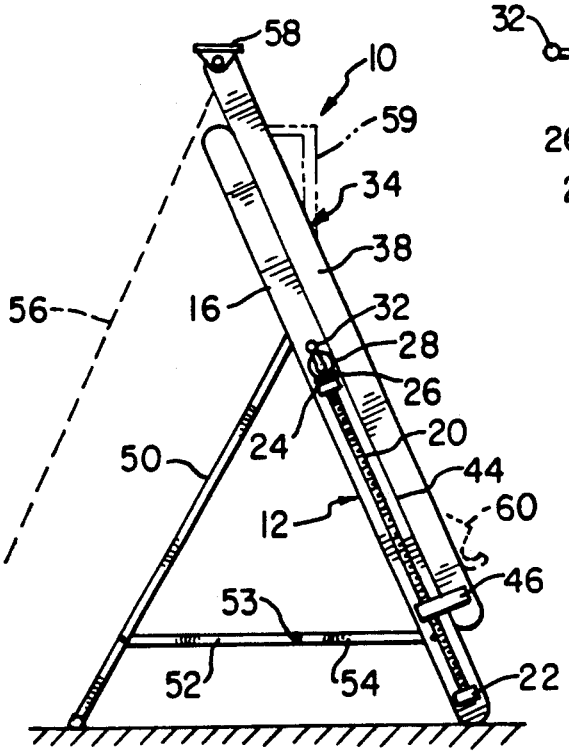
FIG. 2 is a side view of the ladder of FIG. 1 in the retracted state.
Figure 3:
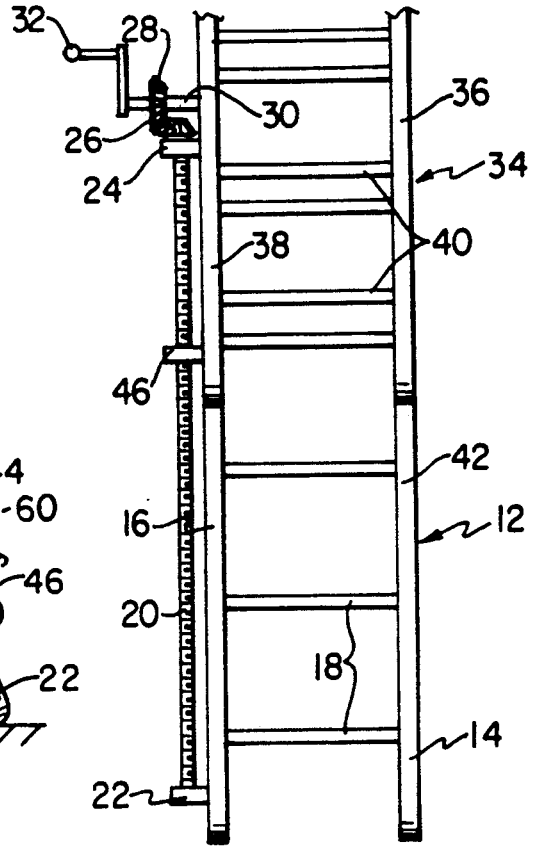
FIG. 3 is a partial front view of the ladder of FIG. 1.

FIGS. 1-3 illustrate an all purpose ladder 10 that includes a base ladder segment 12 with a right side piece 14, a left side piece 16 and a plurality of rungs or steps 18 which span the distance between the side rails or sidepieces 14, 16 and are equally spaced from. one another. The steps 18 are at right angles to the side pieces 14, 16 and are rigidly connected thereto at the respective ends of the steps 18. If desirable, unequally spaced steps may be employed.

A shaft 20 having a worm thread spiraled there around is rotatably mounted from the outside surface of the left side piece 16 by means of bearings 22, 24 fixedly connected to the side piece 16. The shaft 20 extends through the bearing 24 and connects to a beveled gear 26 that engages a second bevel gear 28 mounted on a shaft 30 that is rotatably supported on the side piece 16. A crank handle 32 is connected to the shaft 30 on the bevel gear 28 such that rotation of the crank handle 32 causes bevel gear 28, bevel gear 26 and the worm shaft 20 to rotate, about their central or longitudinal axes.

It should be understood that an electric motor or pneumatic drive could be used to rotate the shaft 20. Also, the shaft 20 may be fabricated with conventional machine threads rather than the spiraled worm thread described above.

An extendable upper sliding ladder segment 34 comprises a right sidepiece 36 and a left sidepiece 38 held in parallel spacing by means of rungs or steps 40 that connect to the sidepieces in a conventional manner. The sliding ladder segment 34 engages in a conventional sliding arrangement (e.g. by means of open brackets, not shown) with the sidepieces 14, 16 of the base ladder 12.

A bracket 46, having internal threads corresponding to the threads on the shaft 20, is mounted on the shaft 20 and is fixedly connected to the left sidepiece 38 of the sliding ladder segment 34 near the bottom end thereof. The bracket 46 is fastened to the sidepiece 38 in any suitable manner, for example, welding, bolts, screws, clamps, etc. When this connection between the bracket and the sliding ladder segment 34 is disconnectable, it is possible to disassemble the ladder 10 for more convenient and compact packing, storage and transportation.

Accordingly, when the crank handle 32 is turned in one direction, the shaft 20 rotates and the bracket 46 translates axially along the shaft 20 causing the upper sliding ladder segment 34 to extend itself beyond the fixed base ladder segment 12. Extension of the sliding ladder segment 34 is limited when the bracket 46 abuts the bearing 24. When the crank handle 32 is rotated in the opposite direction, the sliding ladder segment 34 is lowered until the bracket 46 abuts the bearing 22 at the base of the fixed ladder segment 12. Other stops can be provided to limit the range of travel for the upper sliding ladder segment 34 and it can be stopped at any position between the end points of its range of motion.

It is possible to connect the shaft 20 to the upper ladder and the bracket 46 to the base ladder. Also the shaft and bracket may be located on the right side of the ladder or on the inner part of the side rails or sidepieces.

Struts or legs 50 are pivotably connected to the right and left sidepieces 14, 16, respectively, of the base ladder segment 12 and are extendible away from the base of the ladder 10 (FIG. 2) to form a freestanding ladder 10, as with a conventional step ladder. Pairs of secondary struts 52, 54 are pivotably connect together at pivot points 53. The other ends of the struts 54 connect to the left sidepiece 16 and right sidepiece 14 of the base ladder segment 12. The other ends of the struts 52 connect to the strut 50. When the struts 50 are pivoted to rest against the sidepiece 16, the struts 52, 54 fold together at the pivot point 53 so as to lie parallel and adjacent to each other. The secondary struts 52, 54 prevent the struts 50 from being excessively spread apart from the base segment 12 to the point where the ladder may become unstable. A cross member 51 connected to the legs 50 prevents the legs from spreading apart laterally.

In an alternative embodiment of an all purpose ladder in accordance with the invention, a leg or legs 56, shown in a broken line in FIGS. 1 and 2 extend from the sliding ladder segment 34 to the ground. These legs 56 is also pivotably mounted so that their use is optional.

A resilient pad 58 is placed at the free end of the sliding ladder segment 34 for making contact with a ceiling. Also, a shelf 59 (shown in dotted line in FIG. 2) can extend between the sidepieces 36, 38 of the sliding ladder segment 34 at any position along its length for carrying loads upward when the segment 34 is raised.

Figure 4:
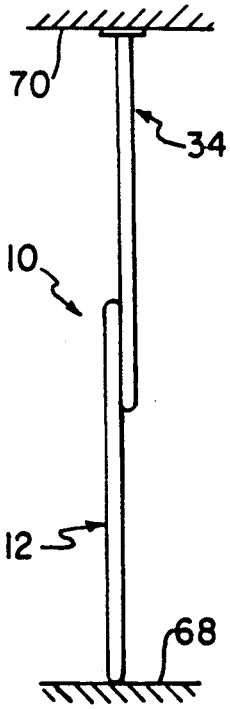
FIG. 4 is a schematic drawing of a ladder in accordance with the invention positioned between a floor and ceiling of a room.

A hook 60 (FIG. 2) on the sliding ladder segment 34 can be attached to one of the rungs 40 and/or the sidepieces, 36, 38. This hook may be used as a jack, for example, to raise the end of an automobile off the ground or to lift other loads. FIG. 4 illustrates a ladder 10 wedged between ceiling 70 and floor 68 in an upright position. To further stabilize the ladder 10, when wedged with the ceiling, the ladder may be slanted and the legs 50, 56 may be used.

The ladder 10 can also be used to hold objects (not shown) against the ceiling while they are being fastened thereto. The ladder 10 may be raised from its retracted position to its extended position while in the freestanding state as shown in FIG. 2, with the object located on pads 58 until contact is made with the ceiling.

Figure 5:
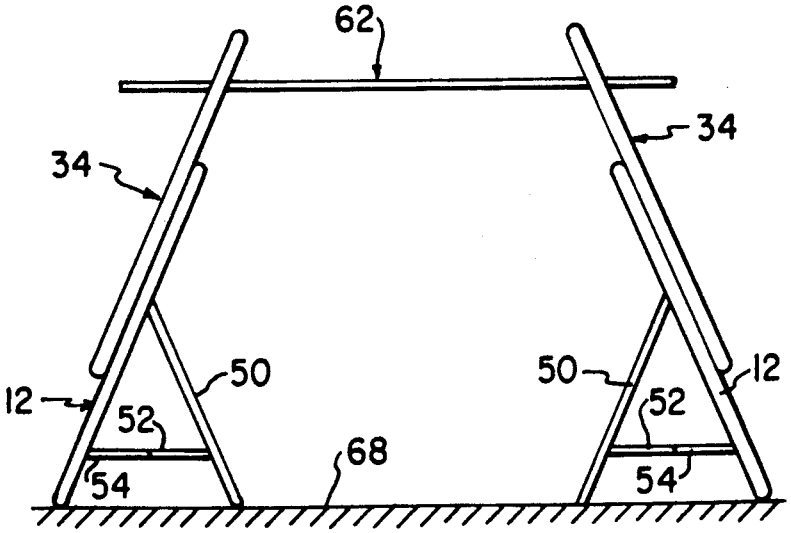
FIG. 5 is a schematic drawing of two all purpose ladders in accordance with the invention used as a scaffold.

FIG. 5 illustrates how two ladders 10 in accordance with the invention may be used to support a scaffold. The scaffold platform 62 is placed on rungs 40 of the sliding ladder segment 34 with the platform substantially parallel to the floor 68. Then the ladders 10 are extended either simultaneously or in alternating increments such that the scaffold platform 62 always remains horizontal or substantially so. In this way, a scaffold can be created and loads may be lifted with just a few minutes of set-up time.

In its retracted state, the ladder 10 serves the functions of a step ladder when the legs 50, 56 are extended. As such, it is freestanding. Additionally, the ladder may be extended and the degree of extension is continuous. Short extension segments (not shown) of a conventional type may be added to the upper end of the sliding ladder segment 34, for example, by means of hooks (not shown) which loop over the rungs 40. Thus, the additional segment moves with the sliding ladder segment 34.

The ladder in accordance with the invention has the advantages described above, being able to serve the functions of a step ladder and an extendible ladder. It is easily set up and operated by one person, is simple in construction, readily transportable in its retracted state, and operates without use of ropes, pulleys, etc. as in conventional extension ladders.

It will thus be seen that the objects set forth above, among those made apparent from the preceding description, are efficiently attained and, since certain changes may be made in the above constructions without departing from the scope and spirit of the invention, it is intended that all matter contained in the above description or shown in the accompanying drawings, shall be interpreted as illustrative and not in a limiting sense.

It is also to be understood that the following claims are intended to cover all of the generic and specific features of the invention herein described and all statements of the scope of the invention which might be said to fall therebetween.

What is claimed:

1. An all-purpose ladder comprising:

a base ladder segment having a first base sidepiece, a second base sidepiece and a plurality of transverse rungs joining said base sidepieces, said base sidepieces being of extended length and having top and bottom ends;

a sliding ladder segment having a first sliding sidepiece, a second sliding base sidepiece and a plurality of transverse rungs joining together said sliding sidepieces, said sliding sidepieces being of extended length and having top and bottom ends, said sliding sidepieces being generally parallel, adjacent and slidably engaged with the base sidepieces, said ladder segments being translatable relative to each other in the lengthwise direction of said sidepieces;

a threaded shaft of extended length connected to the first sidepiece of one of said base ladder segment and said sliding ladder segment, said shaft being mounted for rotation about its longitudinal axis, said shaft extending from a point towards the bottom of the first sidepiece to a point spaced therefrom in the direction toward the top of the first sidepiece;

a bracket having a threaded aperture engaged on said threaded shaft, said bracket moving in one direction along the length of said shaft when said shaft rotates in a first direction and moving in the opposite direction along the length of said shaft when said shaft rotates in the reverse direction, said bracket being attached to the first sidepiece of the other of said base ladder segment and said sliding ladder segment at a point towards to one of the bottom and top thereof, respectively, such that said sliding ladder segment moves in response to rotation of said shaft between a position in which the bottoms of the sidepieces are generally adjacent each other and a position in which they are remote from each other whereby the overall length of said ladder is adjustable.

2. An all-purpose ladder as in claim 1, further comprising a first pair of support legs of extended length, one of each of said legs being pivotably connected at one end to each of said base sidepieces, the other ends of said legs being pivotable away from said base ladder segment to make contact with a surface supporting the base ladder segment such that the ladder becomes free-standing.

3. An all-purpose ladder as in claim 1, further comprising a second pair of legs of extended length, said second legs being pivotably connected to said sliding ladder segment and pivotable away from said sliding ladder segment to support said ladder in a free-standing position in use.

4. An all-purpose ladder as in claim 1, further comprising a hook attached to a rung of said sliding ladder segment for movement therewith, said hook being dimensioned for attachment to and for lifting loads as said ladder is extended.

5. An all-purpose ladder as in claim 1, further comprising padding means at an upper free end of said sliding ladder segment of said ladder for contact with an overhead object.

6. An all-purpose ladder as in claim 1, further includes means for rotating said shaft including gear means for connection to said shaft, and crank means for causing said gear means to rotate.

7. An all-purpose ladder as in claim 6, wherein said gear means include first and second mating bevel gears, said first bevel gear having its rotating axis along the rotating axis of said shaft and rotating therewith, said second bevel gear mating with said first bevel gear and having said crank connected thereto, rotation of said crank causing said second bevel gear to rotate said second first gear.

8. An all-purpose ladder as in claim 1, wherein the shaft is connected an outside surface of a sidepiece of said base ladder segment and said bracket is attached to an outside surface of said sliding ladder segment on the same side as the shaft.

* * * * *